US005443716A

United States Patent [19]

Anderson et al.

[11] Patent Number: 5,443,716

[45] Date of Patent: Aug. 22, 1995

[54] PROCESS FOR CONVERTING OLIGOMER-CONTAINING WASTE STREAMS TO FUELS

[75] Inventors: Ken B. Anderson, Lisle; Jeffrey T. Miller, Naperville, both of Ill.

[73] Assignee: Amoco Corporation, Chicago, Ill.

[21] Appl. No.: 314,360

[22] Filed: Sep. 28, 1994

[51] Int. Cl.[6] ..... C10G 11/00; C07C 4/06

[52] U.S. Cl. ..... 208/113; 585/832; 585/241

[58] Field of Search ..... 589/241, 832; 208/113

[56] References Cited

U.S. PATENT DOCUMENTS 4,151,216 4/1979 Smith ..... 585/241

4,175,211 11/1979 Chen et al. ..... 585/241

5,079,385 1/1992 Wu ..... 585/241

*Primary Examiner*—Asok Pal

*Assistant Examiner*—Bekir L. Yildirim

*Attorney, Agent, or Firm*—Thomas A. Yassen; Richard A. Kretchmer

[57] ABSTRACT

A process is provided for converting a hydrocarbon feedstock comprising at least 2 volume percent of a low molecular weight oligomer to hydrocarbon product useful in the manufacture of fuels comprising contacting the hydrocarbon feedstock with a catalytic cracking catalyst at catalytic cracking conditions for converting at least a portion of the low molecular weight oligomer to hydrocarbon suitable for blending into fuels.

20 Claims, No Drawings

PROCESS FOR CONVERTING OLIGOMER-CONTAINING WASTE STREAMS TO FUELS

BACKGROUND OF THE INVENTION

This invention relates to a process for disposing of low value oligomeric hydrocarbon and producing higher value hydrocarbon products. More particularly, this invention relates to a process for upgrading low value oligomeric hydrocarbon in a fluid catalytic cracking process ("FCC") to produce higher value hydrocarbons, including those useful for the production of fuels.

The commercial production of solid polymers often results in the production of liquid by-product wastes that must be disposed of in the course of doing business. For example, commercial polystyrene plants can often produce minor amounts of a liquid by-product waste stream comprising unpolymerized styrene, dimers, trimers, and low molecular weight oligomers that are not easily consumed internal to the plant. Based on an estimate of about 1% of the total polystyrene produced, this liquid by-product waste from polystyrene plants amounts to more than 200,000 barrels per year of liquid by-product waste that must be landfilled, incinerated, or otherwise disposed of. Moreover, this liquid by-product material is classified by the Environmental Protection Agency as a hazardous waste due to its volatility and flammability and must be disposed of accordingly. The disposal cost, administrative effort, and the complexity involved in managing this waste stream are substantial.

While there has been this long felt need in the chemical industry for a low cost method of disposing of such liquid by-product wastes comprising unpolymerized monomers, dimers, trimers, and low molecular weight oligomers, this need has been neglected and these materials continue to be incinerated or landfilled at alarming rates.

The need to dispose of solid polymeric organic wastes such as plastics and rubber has been recognized and methods for disposing of such solid wastes have been under development for several years. These methods generally require the use of physical, chemical, or thermal means to break down the solid organic waste followed by a thermal or catalytic reaction step to convert the organic waste to higher value products.

The thermal conversion methods generally include a pyrolysis or coking reaction which requires heating a mixture containing the solid organic waste to high temperatures and, in the absence of a catalyst, for thermally cracking the organic waste to lower molecular weight hydrocarbon.

For example, U.S. Pat. No. 4,118,281 to Yan discloses such a process for disposing of solid organic wastes in a coking process. The process comprises slurrying solid organic wastes in hot coker recycle or fresh petroleum feedstocks at temperatures ranging from 300° F. to 1000° F. and coking the feedstock to produce gas, oil, and coke.

U.S. Pat. No. 4,724,068 to Stapp discloses a process for increasing the API gravity of a hydrocarbon feedstream boiling at a temperature in excess of 1000° F. The process comprises contacting the hydrocarbon stream with hydrogen, hydrogen sulfide, and a polymer, which is solid at 25° C. and 1 atmosphere and contains homopolymers and/or copolymers of olefinic monomers. The contacting step is conducted in the absence of any solid, inorganic cracking catalysts or hydroconversion catalysts promoted with metals or compounds of metals.

The catalytic conversion methods generally require heating a mixture comprising the solid organic wastes to high temperatures and contacting the mixture with a catalyst for catalytically converting the organic wastes to lower molecular weight hydrocarbons.

For example, U.S. Pat. No. 4,175,211 to Chen et al. discloses a process for disposing of solid polymeric wastes in an FCC. The process comprises solubilizing rubber and/or plastic solid wastes at high temperatures with a refractory petroleum stream and catalytically cracking the mixture.

U.S. Pat. No. 4,151,216 to Smith discloses a process for converting solid by-product polypropylene to a high viscosity fuel oil suitable for pumping and storage. The process comprises heating the solid by-product polypropylene to a temperature ranging from about 150° C. to about 350° C. to provide a molten feedstock, and contacting the molten feedstock with a silica-on-alumina catalyst containing 5 to 20 percent by weight silica. The process is conducted in a tubular reactor at temperatures ranging from about 425° C. to 475° C.

U.S. Pat. No. 4,108,730 to Chen et al. discloses a process for converting relatively ash-free solid polymeric wastes, such as rubber tires or plastic, to more valuable liquid, solid, and gaseous products in an FCC. The process comprises grinding the polymeric wastes, slurrying the ground wastes in a petroleum-derived stream, heating the slurry to dissolve the polymeric waste, and processing the dissolved wastes in an FCC.

U.S. Pat. No. 4,143,086 to Carle et al. discloses a process for disposing of amorphous polypropylene and titanium catalyst residue in an FCC. The process comprises at least partially dissolving the amorphous polypropylene and titanium catalyst residue in FCC slurry oil through heating and mixing means and processing the composite feedstock in an FCC cracking process. The titanium catalyst residue beneficially deactivates metals present in the FCC process that can poison the catalytic cracking catalyst.

Another process endeavors to combine a thermal cracking step with a catalytic cracking step for converting solid organic waste to higher value hydrocarbon.

U.S. Pat. No. 4,851,601 to Fukuda et al. discloses a process for producing low pour point hydrocarbon. The process comprises thermally cracking molten plastic waste material and contacting the thermally cracked products with an intermediate pore size zeolite, such as ZSM-5, at a temperature of from 200° C. to 340° C. to effect low temperature catalytic cracking of the thermally cracked products.

The above processes have met with marginal technical success and only limited commercial success. The above processes generally require a solid organic waste collection step which requires the processing facility operator to collect such wastes or contract with outside waste collectors. Where the organic wastes comprise plastics, the collected materials are generally an assortment of various plastics and contaminants that can prove detrimental to the thermal or catalytic cracking process. For example, polyvinyl chloride (PVC), a commonly collected plastic, is a particularly undesirable feedstock for an FCC as it can cause equipment fouling and corrosion. Contaminants such as bottle labels and metal caps must also be accommodated.

Once the collection obstacles are overcome, the solid organic waste must be solubilized for injection into the process. This step often requires the addition of liquid solvent streams and high temperatures. In particular, the process requires solids-grinding, solvent-mixing, and high temperature melting steps that are difficult to perform continuously and can require a tedious batch-mixing process. Under even the most ideal of circumstances, complete solubility can not be expected and the process operator risks equipment pluggage, fouling, and costly process downtime.

Where the solubilized organic wastes comprise polystyrene, the polystyrene may be converted to and remain as styrene. Styrene monomer is a known equipment foulant, particularly with regard to heat exchanger and distillation tower internals. If the polystyrene solid organic waste is not fully converted to another chemical form such as ethylbenzene, equipment failure and costly unit downtime are imminent.

Processing solid polymeric organic wastes on an FCC poses costly processing penalties aside from those connected to accumulating and preparing the waste for injection and the deleterious effects of the contaminants. Adding solid polymeric organic wastes such as plastic or rubber to an FCC result in a substantial increase in coke formation on the FCC catalyst. This coke must be burned off of the catalyst in the FCC regenerator resulting in an increase in the regenerator temperature and an increase in the temperature of the catalyst provided from the regenerator to the reaction step. Since most commercial FCCs operate in heat balance and the regenerated FCC catalyst is contacted with the feedstock such that the combined reaction mixture of regenerated catalyst and feed are maintained at a targeted reaction temperature, the ratio of catalyst to oil necessary to meet this reaction temperature target will be reduced. When the catalyst to oil ratio is reduced, overall FCC conversion of higher boiling hydrocarbon to more valuable lower boiling hydrocarbon is reduced, thereby resulting in a substantial downgrade in FCC product value. In short, adding solid polymeric organic wastes to FCC feedstock for processing in an FCC has been shown to increase catalyst coke formation and lower catalyst to oil ratios such that the product slate produced from the FCC is substantially downgraded in value.

For all of the reasons set forth above, chemical plant and refinery operators have avoided the risks attendant to processing solid polymeric organic wastes as set forth hereabove or applying these or similar technologies to liquid by-product wastes and the technology has languished. This is notwithstanding the fact that: (1) most chemical plant and refinery operators already possess much of the capital equipment necessary to process these materials using the methods described above, and (2) landfill costs are exceedingly high and increasing every day.

It has now been found that an entire field of organic wastes comprising unpolymerized monomers, dimers, trimers, low molecular weight oligomers that, to date, have been historically landfilled as a hazardous waste or incinerated, can be catalytically reacted in an FCC to produce higher value hydrocarbon.

It has been found that injection of a feedstock comprising unpolymerized monomers, dimers, trimers, and low molecular weight oligomers, as defined herein, into an FCC does not increase overall FCC catalyst coke make, notwithstanding the fact that extensive research has shown that solid polymeric materials such as plastic and rubber generally increase catalyst coke make in an FCC. Surprisingly, it has been found that the injection of the feedstock contemplated herein actually reduces FCC catalyst coke yield below that of many conventional FCC feedstocks thereby providing a net processing incentive to accommodate such feedstocks.

It has also been found that injection of a feedstock comprising unpolymerized monomers, dimers, trimers, and low molecular weight oligomers, as defined herein, is not compromised by any of the previously identified problems relating to waste collection, sorting, processing, solubility, equipment pluggage, and contamination that have derailed previous attempts to monetize solid polymeric organic wastes.

It is therefore an object of the present invention to provide a safe, efficient, and economic process for monetizing unpolymerized monomers, dimers, trimers, and low molecular weight oligomers that have been historically landfilled or incinerated.

It is another object of the present invention to provide a process for catalytically cracking a feedstock comprising unpolymerized monomers, dimers, trimers, and low molecular weight oligomers that does not increase FCC catalyst coke yield and increases FCC product value.

It is yet another object of the present invention to provide a process for catalytically cracking a feedstock comprising unpolymerized monomers, dimers, trimers, and low molecular weight oligomers that is not compromised by problems relating to waste collection, sorting, processing, solubility, equipment pluggage, and contamination such as those that have discouraged previous attempts to monetize solid polymeric organic wastes.

Other objects appear herein.

SUMMARY OF THE INVENTION

The above objects can be achieved by providing a process for converting a hydrocarbon feedstock comprising at least 2 volume percent of a low molecular weight oligomer to hydrocarbon product useful in the manufacture of fuels comprising contacting the hydrocarbon feedstock with a catalytic cracking catalyst at catalytic cracking conditions for converting at least a portion of the low molecular weight oligomer to hydrocarbon suitable for blending into fuels.

In another embodiment, the above objects can be achieved by providing a process for converting a liquid hydrocarbon feedstock comprising at least 5 volume percent of a low molecular weight oligomer having a molecular weight of between about 100and about 30,000 and at least 20 volume percent of the composite of monomers, dimers, and trimers to hydrocarbon product useful in the manufacture of fuels. The process comprises contacting the hydrocarbon feedstock with a catalytic cracking catalyst at catalytic cracking conditions comprising a reaction temperature ranging from about 900° F. to about 1100° F. and a reaction pressure ranging from about 0 psig to about 100 psig, in a catalytic cracking process for converting at least a portion of the low molecular weight oligomer to hydrocarbon having a lower molecular weight.

The process of the present invention provides a safe, efficient, and economic process for monetizing unpolymerized monomers, dimers, trimers, and low molecular weight oligomers that have been historically landfilled or incinerated. The process of the present invention converts an otherwise undesirable and inconvenient waste stream that is ordinarily disposed of at a net cost to the producer, into more valuable products such as high octane gasoline and distillate fuels.

The process of the present invention converts unpolymerized monomers, dimers, trimers, and low molecular weight oligomers in an FCC without adversely affecting ordinary FCC operations. Surprisingly, the addition of these unpolymerized monomers, dimers, trimers, and low molecular weight oligomers actually enhances the value of the product slate produced from the FCC by reducing FCC coke yield which reduces catalyst regeneration temperature, permits higher catalyst to oil ratios, and results in higher conversion of the FCC feedstock to more valuable products such as gasoline and distillate fuels.

The process of the present invention is easily implemented and avoids most, if not all, of the problems associated with the addition of solid polymer wastes to an FCC. These problems include difficulties associated with waste collection, sorting, processing, solubility, equipment pluggage, and contamination.

The process of the present invention is environmentally beneficial. If fully implemented industry-wide, the process of the present invention could remove 200,000 barrels per year of unpolymerized monomers, dimers, trimers, and low molecular weight oligomers from landfills and incinerators. Domestically, this technology permits refiners to reduce their petroleum crude requirements by a volume level nearly equivalent to the volume of hydrocarbon feed processed in accordance with the present invention.

BRIEF DESCRIPTION OF THE INVENTION

The hydrocarbon feedstock suitable for use with the present invention generally comprises at least one or more of unpolymerized monomers, dimers, trimers, and low molecular weight oligomers.

The monomers from which the unpolymerized monomers, dimers, trimers, and low molecular weight oligomers are constructed can comprise any of substituted alkenes, substituted alkynes, aliphatics, alicyclics, and aromatics having a suitable unsaturated side chain or substituent. The preferred monomers have from about 2 to about 15 carbon atoms, more preferably from about 3 to about 10 carbon atoms, and most preferably from about 6 to about 12 carbon atoms for best results. Common monomers suitable for use with the present invention include ethylene, propylene, butylene, methylstyrene, and styrene, with styrene being most preferred.

The low molecular weight oligomers preferably comprise from about 2 to about 500 monomers, preferably from about 2 to about 350 monomers, and more preferably from about 2 to about 200 monomers for best results. The molecular weight of these low molecular weight oligomers generally falls within the range of from about 58 to about 55,000, more preferably from about 100 to about 30,000, and most preferably from about 200 to about 15,000 for best results. Polymers outside of and above these ranges can result in a feedstock having undesirable fluid flow properties and catalyst coking tendencies. The oligomer side chains can be configured as atactic, isotactic, or syndiotactic.

The hydrocarbon feedstock suitable for use with the present invention comprises at least 2 volume percent of the low molecular weight oligomer, preferably at least 5 volume percent, and more preferably at least 10 volume percent for best results. The hydrocarbon feedstock suitable for use with the present invention also generally comprises at least 10 volume percent of the total of all unpolymerized monomers, dimers, and trimers, preferably at least 20 volume percent, and more preferably at least 30 volume percent for best results. The total of all unpolymerized monomers, dimers, trimers, and low molecular weight oligomers in the hydrocarbon feedstock should preferably amount to at least 25 volume percent, more preferably at least 50 volume percent, and most preferably at least 75 volume percent for best results. The hydrocarbon feedstock may also comprise mineral oil that is commonly injected into chemical plants to enhance the quality of the chemical product produced.

The composite hydrocarbon feedstock in accordance with the present invention is preferably a liquid at ambient conditions and has a viscosity of not more than 1000 cs at 212° F., preferably not more than 800 cs at 212° F., and more preferably not more than 650 cs at 212° F. for best results. The preferred properties of the hydrocarbon feedstock may also be expressed in terms of pour point wherein the feedstock preferably has a pour point (ASTM D97) of not greater than 200° F. and more preferably not greater than 100° F. for best results. Excessive viscosities and/or pour points generally result in additional capital requirements, equipment fouling, and can result in greater FCC catalyst coking tendencies.

Typical sources of hydrocarbon feedstock for processing in accordance with the present invention include polymer manufacturing facilities such as a polystyrene chemical plant. In conventional polystyrene plants, the polymerization reaction takes place in one or more polymerization reactors which can be configured in parallel, series, or in combinations thereof. The appropriate monomer (i.e., styrene for a polystyrene facility) is injected into the lead reactor or reactors along with any additional feedstock components or additives which may be added to facilitate the polymerization reaction or enhance the final product. Mineral oil and rubber are two such feedstock components commonly injected to commercial polystyrene plants for enhancing the final polystyrene product.

The polystyrene conversion reaction is generally a thermal reaction which takes place at elevated temperatures and generally in the absence of a solid catalyst. The degree of conversion and the appropriate polystyrene properties are generally controlled by the mix of feedstock components and the process conditions of temperature, pressure, and space velocity.

The product from the polystyrene polymerization reaction section generally comprises the polystyrene product along with one or more of unconverted styrene monomer, dimers, timers, mineral oil, rubber, and other components or contaminants found in or introduced into the feedstocks or product during the reaction.

The reaction section product is generally directed to a product recovery section for recovering polystyrene product for subsequent downstream processing. Some commercial polystyrene product recovery sections are equipped with facilities for separating and removing unconverted monomers for recycle back to the reaction section. The polystyrene and unconverted monomer recovery steps can be performed using any of several separation methods known to those skilled in the art but most commonly are performed through pressurized, atmospheric, or vacuum distillation or stripping. The remaining hydrocarbon waste stream comprising styrene dimers, trimers, and low molecular weight oligomers is not generally suitable for sale as polystyrene product or to facilitate the polymerization reaction as part of the recycle stream.

This waste stream, however, is a particularly suitable hydrocarbon feedstream for use with the present invention. While it is quite common for significant portions of unconverted styrene monomer to remain in the hydrocarbon waste stream, particularly where the process is not equipped with styrene monomer recovery facilities, the FCC readily upgrades this material to valuable gasoline components such as ethyl benzene. The fractions of polystyrene that are not successfully removed in the product recovery section are similarly converted to valuable fuel grade hydrocarbon.

Another source of hydrocarbon feedstock suitable for processing in accordance with the present invention includes processes for manufacturing chemical and polymer grade monomers such as, but not limited to, styrene.

Conventional styrene facilities commonly react a hydrocarbon feedstock comprising benzene with ethylene over a suitable alkylation catalyst to form ethylbenzene. Often, the catalyst is aluminum chloride ($AlCl_3$) and the reaction is a Friedl Crafts alkylation conducted in mixed alkylation reactors. The product from the alkylation reaction is washed and neutralized for subsequent downstream processing which optionally may include transalkylation to further enhance the yield of ethylbenzene.

A common ethylbenzene purification step after alkylation and transalkylation comprises the fractionation of by-products such as of di- and tri-ethylbenzene and di-phenyl ethane from the ethylbenzene. The fractionation step is generally a distillation step.

The by-product waste stream comprising di- and tri-ethylbenzene and di-phenyl ethane is a particularly suitable feedstock for use with the present invention.

The high quality ethylbenzene from the alkylation section is directed to a dehydrogenation reaction section for dehydrogenation to styrene in the presence of a catalyst such as iron oxide. The dehydrogenation reaction section generally consists of one or more fixed bed reactors which can be configured in parallel, series, or in combinations thereof.

Hydrogen and light hydrocarbon that is formed during the dehydrogenation reaction is removed from the crude styrene product in downstream fractionation facilities. Benzene and toluene can also be formed in the dehydrogenation section and are generally removed from the crude styrene product and recycled back to the upstream alkylation section for conversion to ethylbenzene. The fractionation facilities and process steps can include any of several known to those skilled in the art but most commonly utilize pressurized, atmospheric, or vacuum distillation or stripping.

The crude styrene is directed to a final separation step for removal of undesirable higher boiling components (i.e., styrene residue) formed during the dehydrogenation reaction. This final separation step can comprise any of the above-described separation schemes, including but not limited to, pressurized, atmospheric or vacuum distillation, stripping, or thin film evaporation, with thin film evaporation methods being most preferred. The styrene residue generally comprises oligomeric styrene, unconverted dehydrogenation feedstock components such as di- and tri-ethylbenzene and di-phenyl ethane, by-products produced during the dehydrogenation reaction that boil at boiling temperatures suitably apart from the boiling temperature of styrene, as well as portions of styrene, benzene, and toluene that are lost through inefficiencies in the various separation steps.

This styrene residue stream comprising oligomeric styrene, unconverted dehydrogenation feedstock components, by-products produced during the dehydrogenation reaction boiling at temperatures suitably apart from the boiling temperature of styrene, and portions of styrene, benzene, and toluene lost through inefficiencies in the various separation steps is also a particularly suitable feedstock for use with the present invention.

The hydrocarbon feedstock preferably supplements the addition of a conventional catalytic cracking feedstock to the FCC. The conventional catalytic cracking feedstock comprises hydrocarbon having a boiling temperature range at atmospheric pressure of from about 150° F. to about 1300° F. Traditional catalytic cracking feedstocks can comprise a distillate boiling range fraction boiling at a temperature of from about 150° F. to about 700° F., a gas oil fraction boiling at a temperature of from about 700° F. to about 1000° F., and a high boiling residual fraction boiling at temperatures in excess of 1000° F. Most catalytic cracking feedstocks, including those suitable for use with the present invention, are dominated by the gas oil fraction.

Suitable petroleum refinery sources for catalytic cracking feedstock include virgin distillate, gas oil, and residual fractions derived from a crude oil primary or vacuum fractionator. These fractions include, but are not limited to, light, middle, or heavy distillates, primary gas oils, light or heavy vacuum gas oils, and vacuum resids. The virgin feedstocks can be derived from low, medium, or high sulfur crude sources or any combinations thereof. Catalytic cracking feedstocks may also be derived from petroleum sources after interceding process steps, such as hydroprocessing, including hydrotreating and hydrocracking, fluidized or delayed coking, or catalytic cracking wherein FCC products can be recycled directly or indirectly back to catalytic cracking feedstock. Catalytic cracking feedstock can also include feedstocks derived from alternative hydrocarbon sources such as shale oil, tar sands, diatomaceous earth oil, coal liquification products, or other synthetic oils. Such fractions may be employed alone or in any desired combination.

Fluid catalytic cracking catalysts suitable for use with the present invention include those of the amorphous silica-alumina type having an alumina content of from about 10 to about 30 weight percent. Catalysts of the silica-magnesia type are also suitable which have a magnesia content of about 20 weight percent. Preferred catalysts include those of the zeolite-type which comprise from about 0.5 to about 50.0 weight percent and preferably from about 1.0 to about 30.0 weight percent of a crystalline aluminosilicate component distributed throughout a porous matrix. Zeolite-type cracking catalysts are preferred because of their thermal stability and high catalytic activity.

The crystalline aluminosilicate or zeolite component of the zeolite-type cracking catalyst can be of any type or combination of types, natural or synthetic, which are known to be useful in catalyzing the cracking of hydrocarbons. Suitable zeolites include both naturally occurring and synthetic aluminosilicate materials such as faujasite, chabazite, mordenite, Zeolite X (U.S. Pat. No. 2,882,244), Zeolite Y (U.S. Pat. No. 3,130,007), and ultrastable large-pore zeolites (U.S. Pat. Nos. 3,293,192 and 3,449,070). The crystalline aluminosilicates having a faujasite-type crystal structure are particularly suitable and include natural faujasite, Zeolite X, and Zeolite Y.

The above-described zeolites are usually prepared or occur naturally in the sodium form. The presence of this sodium is undesirable, however, since the sodium zeolites have a low catalytic activity and also a low stability at elevated temperatures in the presence of steam. Consequently, the sodium content of the zeolite is ordinarily reduced to the smallest possible value, generally less than about 1.0 weight percent, and preferably below 0.3 weight percent, through ion exchange with hydrogen ions, hydrogen precursors such as ammonium ion, or polyvalent metal cations including calcium, magnesium, strontium, barium, and the rare earth metals such as cerium, lanthanum, neodymium, and their mixtures.

Suitable zeolites are also able to maintain their pore structure under the high temperature conditions of catalyst manufacture, hydrocarbon processing, and catalyst regeneration. These materials have a uniform pore structure of exceedingly small size, the cross section diameter of the pores being in the range of about 4 to about 20 angstroms and preferably from about 8 to about 15 angstroms.

The matrix of the zeolite-type cracking catalyst is a porous refractory material within which the zeolite component is dispersed. Suitable matrix materials can be either synthetic or naturally occurring and include, but are not limited to, silica, alumina, silica alumina, zirconia, magnesia, boria, bauxite, titania, natural and treated clays, kieselguhr, diatomaceous earth, kaolin, and mullite. Mixtures of two or more of these materials are also suitable. Particularly suitable matrix materials comprise mixtures of silica and alumina, mixtures of silica with alumina and magnesia, and also mixtures of silica and alumina in combination with natural clays and clay-like materials. Mixtures of silica and alumina are preferred, however, and contain preferably from about 10.0 to about 65.0 weight percent of alumina mixed with from about 35.0 to about 90.0 weight percent of silica.

FCC processes and facilities vary in their configurations but most begin with a feed preparation step wherein the catalytic cracking feedstock is collected and preheated prior to contact with the fluid catalytic cracking catalyst. Since the FCC generally operates in heat balance wherein the heating requirements for the catalytic cracking reaction are supplied from the combustion of catalyst coke produced through the reaction, additional feedstock preheat results in reduced yields of catalyst coke and is often desirable. Preheating is generally conducted in a plurality of heat exchangers which transfer heat from the products produced from the catalytic cracking reaction or from main fractionator pumparound systems which must be necessarily cooled, to the catalytic cracking feedstock. The systems from which heat is transferred to the feedstock are commonly optimized so as to maximize the temperature of the feedstock prior to contact with the catalytic cracking catalyst.

The temperature of the preheated catalytic cracking feedstock generally ranges from about 150° F. to about 800° F., preferably from about 300° F. to about 700° F., and more preferably from about 400° F. to about 600° F. for best results. Excessive temperatures may cause vaporization of portions of the feedstock in the preheat train which may increase pressure drop and lower FCC feed capacity. Lower temperatures generally necessitate higher FCC coke yields, increase regeneration requirements, and may also lower FCC capacity.

Once the catalytic cracking feedstock has been collected and preheated, it is injected into a reaction vessel such as a dilute-phase transfer line or riser reactor where it is contacted with high temperature regenerated catalyst, vaporized, and reacted. Preferably, cracking occurs essentially and exclusively in the riser reactor. In a typical case where riser cracking is employed for conversion of a gas oil, the conversion level may vary from about 40.0 weight percent to about 100.0 weight percent and, more commonly, from about 60.0 weight percent to about 90.0 weight percent. FCC processes preferably operate at conversion levels above 60.0 weight percent and, more preferably, above 70.0 weight percent for best results.

For purposes of the present invention, FCC conversion is defined as the percentage reduction by weight of hydrocarbon boiling at a temperature of above 430° F. at atmospheric pressure by the formation of lighter, lower boiling material or coke.

The weight ratio of total cracking catalyst to oil (i.e., wherein the oil comprises the composite of conventional catalytic cracking feedstock and the hydrocarbon feedstock in accordance with the present invention) in the riser reactor may vary within the range of from about 2 to about 30 in order that the fluidized dispersion will have a density within the range of from about 1 to about 20 pounds per cubic foot. Desirably, the catalyst to oil ratio is maintained within the range of from about 3 to about 20, and preferably from about 3 to about 7 for best results. The fluidizing velocity in the riser reactor may range from about 10 to about 100 feet per second. The riser reactor generally has a ratio of length to average diameter of about 25.

FCC processes in accordance with the present invention generally operate with a riser bottom temperature ranging from about 950° F. to about 1200° F. to insure substantially complete vaporization of the catalytic cracking feedstock. The riser top or FCC reaction temperature is generally maintained in the range of from about 900° F. to about 1100° F., and preferably from about 950° F. to about 1050° F. for best results. Feedstocks comprising high weight percentages of resid and/or synthetic fuel components tend to require higher riser bottom temperatures to insure substantially complete vaporization and effective catalyst/oil mixing. The reaction pressures of FCC processes in accordance with the present invention generally range from about 0 psig to about 200 psig, and preferably from about 0 psig to about 100 psig for best results.

Under the above conditions, including provision for a rapid separation of spent catalyst from effluent oil vapor, a very short period of contact between catalyst and oil should be established. Contact time within the riser reactor should generally be within the range of from about 0.1 to about 15 seconds, preferably within the range of from about 0.1 to about 10 seconds, and more preferably within the range of from about 0.1 to about 7 seconds for best results. Short contact times are preferred because most of the hydrocarbon cracking occurs during the initial increment of contact time, and undesirable secondary reactions are avoided. This is especially important if higher product yield and selectivity, including lower coke production, are to be realized.

Short contact time between catalyst particles and oil vapors may be achieved by various means. For example, catalysts may be injected at one or more points along the length of the lower portion of the riser reactor. Similarly, the catalytic cracking feedstock may be injected at one or more points along the length of the lower portion of the riser reactor. Where the various catalytic cracking and hydrocarbon feedstock components can be segregated, the feedstock injection points can be optimized in consideration of the various reactivities of the segregated feedstock components. The lower section of the riser reactor may, for this purpose, include up to about 80 percent of the total riser length in order to provide extremely short effective contact times conducive to optimum conversion of catalytic cracking feedstocks. Where a dense catalyst bed is employed, provisions may also be made for injection of catalyst particles and/or feedstock directly into the dense-bed zone.

The catalytic reactions generally are not terminated until the cracking catalyst is separated from the catalytically cracked product. This catalyst separation can be performed by any of several solid-from-gas separation devices known to those skilled in the art, These devices include, but are not limited to, ballistic, inertial, or cyclonic separators or any combinations thereof. It is common for such catalyst separation devices to be configured in parallel and in series so as to ensure complete and reliable separation of spent cracking catalyst from catalytically cracked product.

Undesirable secondary reactions, particularly thermal cracking reactions, can be reduced further by the addition of a quench fluid in close proximity to and directly after separation of the spent cracking catalyst from the catalytically cracked product. The quench fluid reduces the temperature of the catalytically cracked product thereby reducing thermal overcracking of the catalytically cracked product to undesirable light hydrocarbon gases such as methane and ethane. Suitable quench fluids for use with the present invention can include hydrocarbon products from the FCC such as light and heavy catalytic cycle oils or other petroleum fractions commonly found in modern petroleum refineries.

In the catalytic cracking process, some non-volatile carbonaceous material, or coke, is deposited on the cracking catalyst particles. Coke comprises highly condensed aromatic hydrocarbons generally containing from about 4 to about 10 weight percent hydrogen. When the hydrocarbon feedstock contains organic sulfur compounds, the coke also contains sulfur. As coke builds up on the cracking catalyst, the activity of the catalyst for cracking and the selectivity of the catalyst for producing gasoline blending stocks diminishes. The cracking catalyst particles may recover a major proportion of their original capabilities by removal of most of the coke therefrom in a suitable regeneration process.

Prior to catalyst regeneration, the spent cracking catalyst from the catalyst separation step is generally stripped in a stripping vessel. The stripping vessel for use in an FCC may suitably be maintained at a temperature of from about 850° F. to about 1200° F. and desirably will be maintained above about 870° F. The preferred stripping gas is steam, although stream-containing nitrogen or other steam-containing inert or flue gas may also be employed. The stripping gas is introduced at a pressure of generally at least 10 psig and preferably at least 35 psig, suitable to effect substantially complete removal of volatile compounds from the spent cracking catalyst.

The spent cracking catalyst separation step may be followed by any of several conventional cracking catalyst regeneration schemes but is advantageously employed with a regeneration scheme comprising at least one dense-bed zone and at least one dilute-phase zone. Stripped spent cracking catalyst particles generally enter the dense-bed zone of the regenerator through suitable conduits evolving from the stripping vessel. Vessel entry may be made through the bottom or from the side of the regenerator but desirably terminates near the top of the dense-bed fluidized zone. Entry may also be from the top of the regenerator where cracking catalyst has first been contacted with substantially spent regeneration gas in a restricted dilute-phase zone.

Catalyst regeneration is accomplished by burning the coke deposits from the catalyst surface with a molecular oxygen-containing gas such as air. Many regeneration techniques are practiced commercially whereby a significant restoration of catalyst activity is achieved in response to the degree of coke removal. As coke is progressively removed from the catalyst, removal of the remaining coke becomes most difficult and, in practice, an intermediate level of restored catalyst activity is accepted as an economic compromise.

Regeneration conditions generally comprise a regeneration temperature ranging from about 1000° F. to about 1600° F., typically from about 1100° F. to about 1500° F., and commonly from about 1200° F. to about 1400° F. for best results. Exceeding the above regenerator temperature constraints may compromise regenerator vessel integrity and/or undesirably affect the stability of the cracking catalyst. Exceedingly low regenerator temperatures can reduce regeneration efficiency and effectiveness. The hot regenerated catalyst from the regenerator is conveyed back to the reaction step through the appropriate valving and conduits.

The catalytically cracked product from the catalyst separation step is generally conveyed to a fractionating tower for separating the product into various component fractions. Traditional FCC fractionators operate as distillation towers integrated with heat transfer equipment for selectively removing heat from the tower to form a temperature profile suitable for removing products having particularly specified boiling temperature ranges. These products commonly include a cracked wet gas product comprising mostly hydrocarbons having 4 carbon atoms or less, a cracked naphtha product comprising hydrocarbons having from about 5 to about 12 carbon atoms and boiling at a temperature of below about 430° F. at atmospheric pressure, a light catalytic cycle oil fraction boiling at a temperature of from about 150° F. to about 700° F. at atmospheric pressure, a heavy catalytic cycle oil fraction boiling at a temperature of from about 400° F. to about 900° F. at atmospheric pressure, and a decanted oil or slurry fraction boiling at a temperature of from about 600° F. to about 1200° F. at atmospheric pressure.

The hydrocarbon feedstock in accordance with the present invention can be injected at any of several locations on an FCC, each location having its own particular advantages and associated penalties.

The hydrocarbon feedstock can be injected into the catalytic cracking feedstock prior to or contemporaneous with feedstock preheating. In this manner, the hydrocarbon feedstock is preheated along with the catalytic cracking feedstock, resulting in good mixing and lower coke yield. However, where the hydrocarbon feedstock comprises monomers such as styrene, which have been shown to cause equipment fouling, injection of such materials upstream and prior to such heat exchange equipment can cause deposit formation resulting in reduced heat transfer and ultimately lower equipment operating factors.

The hydrocarbon feedstock can be injected downstream of the preheating section and just prior to or as part of the reactor injector system. In this manner, equipment fouling problems inherent to some monomer containing hydrocarbon feedstocks are avoided at the expense of reduced preheat.

The hydrocarbon feedstock can be injected into the the bottom of or at any point along the riser reactor vessel. In this manner, the potential for upstream equipment plugging is eliminated. In addition, the location along the riser reactor can be optimized such that quick reacting hydrocarbon feedstocks, in accordance with the present invention, can be added at a location downstream of the conventional catalytic cracking feedstock so as to minimize space velocity and insure maximum FCC conversion.

The hydrocarbon feedstock can be injected into the dilute phase of the disengager vessel. In the dilute phase of the disengager vessel, the feedstock may be exposed to less catalytic cracking catalyst than alternative locations and the catalyst may be contacted after its catalytic activity has been reduced from the riser reaction step. However, the hydrocarbon feedstock of the present invention does not require the degree of catalyst activity that conventional catalytic cracking feedstock does in order to be converted to more valuable hydrocarbon. Additionally, the vaporization and reaction of the hydrocarbon feedstock can function as additional quench thereby further reducing the occurrence of thermal cracking reactions in the disengager. One risk to injection of the hydrocarbon feedstock into the dilute phase of the disengager or as a part of the quench stream is that there will be insufficient cracking catalyst to fully convert monomers, such as styrene, to the desired chemical forms, thereby increasing the potential for downstream equipment fouling. This source of equipment fouling could occur as immediately as inside the disengager vessel where disengager cyclones and cyclone diplegs may be present and exposed. This risk should be considered in the election of injection points.

The hydrocarbon feedstock can be injected into the dense bed of the disengager vessel, which is employed to strip volatile hydrocarbons from the spent cracking catalyst prior to regeneration. Benefits to this location include the presence of adequate concentrations of spent cracking catalyst, that the hydrocarbon feedstock need not occupy space in the riser reactor, and that the hydrocarbon feedstock need not pass through the preheat or injection equipment. However, precautions must be taken such that the hydrocarbon feedstock is not carried out of the regenerator with the spent cracking catalyst to be burned in the catalyst regenerator.

The hydrocarbon feedstock can be injected into the FCC as a pure feedstock but is preferably injected into the FCC along with and as a fraction of a conventional catalytic cracking feedstock. The preferred FCC process in accordance with the present invention comprises injection of a hydrocarbon feedstock into the FCC in an amount ranging from about 0.10 to about 25.0 percent by volume, calculated as a percentage of the sum of the conventional catalytic cracking feedstock and the hydrocarbon feedstock and exclusive of any quench or FCC product recycle streams injected back into the FCC process. Preferably, the hydrocarbon feedstock is injected into the FCC in an amount ranging from about 0.10 to about 15.0 percent by volume and more preferably from about 0.10 to about 10.0 percent by volume for best results. Hydrocarbon feedstock volume percentages in excess of the range set forth above are more difficult to process reliably due to the compositional variability of various types of hydrocarbon feedstocks which can cause process deviations that contribute to less effective operation.

Notwithstanding the teachings of FCC processes developed to accommodate solid plastic wastes, the hydrocarbon feedstock of the present invention is particularly specified so as not to necessitate a separate solvent, diluent, or carrier stream for effective processing in the FCC. Use of such a solvent of diluent stream generally provides little improvement to the process of the present invention and can undesirably increase reactor space velocity.

The process of the present invention provides a safe, efficient, and economic process for monetizing unpolymerized monomers, dimers, trimers, and low molecular weight oligomers that have been historically landfilled or incinerated. Since the hydrocarbon feedstock in accordance with the present invention is commonly produced as a by-product waste stream in polymer and monomer production facilities, it is generally disposed of at a net cost to the producer. The process of the present invention converts this undesirable, inconvenient, and costly waste stream into fuel products such as high octane gasoline which are highly valued in the marketplace.

The process of the present invention converts unpolymerized monomers, dimers, trimers, and low molecular weight oligomers in an FCC without adversely affecting ordinary FCC operations. Suprisingly, the addition of these unpolymerized monomers, dimers, trimers, and low molecular weight oligomers actually enhances the value of the product slate produced from the FCC. The addition of the hydrocarbon feedstock in accordance with the present invention actually reduces coke yield, which reduces catalyst regeneration temperatures, permits higher catalyst to oil ratios, and results in higher conversion of the FCC feedstock to more valuable products such as gasoline and distillate fuels. This benefit is achieved notwithstanding the fact that addition of solid polymer waste products to an FCC actually increase coke yield and deleteriously incurs all of the corresponding penalties.

The process of the present invention is easily implemented and avoids most, if not all, of the problems associated with the addition of solid polymer wastes to an FCC. These problems include difficulties associated with waste collection, sorting, processing, solubility, equipment pluggage, and contamination. The hydrocarbon feedstock in accordance with the present invention can be conveyed in liquid form through most transportation methods known to those skilled in the art including railcar, truck, pipeline, barge, or through any other method or device for conveying liquids from one location to another. There is no sorting or solubility steps that need be performed because the material can be and is generally conveyed in a form suitable for direct processing. The risk of contamination attendant to solid polymer wastes such as from bottle caps, labels, and debris is also removed.

The process of the present invention is environmentally beneficial. If fully implemented industry-wide, the process of the present invention could remove 200,000 barrels per year of unpolymerized monomers, dimers, trimers, and low molecular weight oligomers from landfills and incinerators. Domestically, this technology permits refiners to reduce their petroleum crude requirements by a volume level nearly equivalent to the volume of hydrocarbon feed processed in accordance with the present invention.

The present invention is described in further detail in connection with the following examples, it being understood that the same are for purposes of illustration and not limitation.

EXAMPLE 1

Examples 1–6 were conducted to compare the performance of an FCC processing various conventional catalytic cracking feedstocks and feedstock solvents in the presence of and without solid polystyrene plastic (SPS) in order to establish the benefits of processing solid plastic wastes, not in accordance with the present invention, in an FCC. A sample of light catalytic cycle oil (LCCO) was collected for use as a solvent to dissolve SPS prior to injection into an FCC pilot plant. Feedstock inspection data for the LCCO solvent is provided in Table 1.

EXAMPLE 2

A sample of high sulfur heavy vacuum gas oil (HS-HVGO) was collected for combining with a portion of the LCCO from Example 1 to be used as a solvent for dissolving SPS prior to injection into an FCC pilot plant. Feedstock inspection data for the HS-HVGO and for a 50%/50% by volume blend of the LCCO of Example 1 and the HS-HVGO of this Example 2 (LCCO/HS-HVGO) is provided in Table 1.

TABLE 1

| | LCCO | HS-HVGO | LCCO/HS--HVGO |
|---|---|---|---|
| Gravity, API | 21.4 | 21.6 | 21.5 |
| Sulfur, Wt % | 0.42 | 2.60 | 1.51 |
| Nitrogen, Wt % | 0.03 | 0.13 | 0.08 |
| $C_A$, Wt % | 32.42 | 13.91 | 23.17 |
| Molecular Weight | 201 | 381 | 263 |
| TBP Distillation, °F, Vol % | | | |
| IBP | 334 | 532 | 334 |
| 5 | 432 | 632 | 453 |
| 10 | 456 | 679 | 476 |
| 20 | 477 | 714 | 511 |
| 30 | 492 | 747 | 551 |
| 40 | 510 | 780 | 597 |
| 50 | 531 | 812 | 645 |
| 60 | 553 | 840 | 714 |
| 70 | 579 | 871 | 780 |
| 80 | 605 | 908 | 841 |
| 90 | 637 | 963 | 911 |
| 95 | 648 | 986 | 964 |
| FBP | 674 | 1038 | 1038 |
| Vol % 430° F.$^-$ | 4.9 | 0.0 | 2.4 |

EXAMPLE 3

A portion of the LCCO from Example 1 was combined with ground SPS in a manner so as to solubilize the solid plastic and provide a solution containing 75% by weight LCCO and 25% by weight SPS. The mixture was passed through a 20 micron filter to remove any remaining particulates. The composite stream molecular weight, API gravity, and volume percent of hydrocarbon boiling at a temperature of below 430° F. at atmospheric pressure for the LCCO/SPS blend is provided in Table 2.

EXAMPLE 4

A portion of the 50%/50% LCCO/HS-HVGO solvent from Example 1 was combined with ground SPS in a manner so as to solubilize the solid plastic and provide a solution containing 43% by weight LCCO, 43% by weight HS-HVGO, and 14% by weight SPS. The mixture was passed through a 20 micron filter to remove any remaining particulates. The composite stream molecular weight, API gravity, and volume percent of hydrocarbon boiling at a temperature of below 430° F. at atmospheric pressure for the LCCO/HS-HVGO/SPS blend is provided in Table 2.

TABLE 2

| | LCCO/SPS | LCCO/HS-HVGO/SPS |
|---|---|---|
| Gravity, API | 16.2 | 18.5 |
| Molecular Weight | 400 | 400 |
| Vol % 430° F.$^-$ | 3.8 | 2.1 |

EXAMPLE 5

The LCCO and LCCO/SPS feedstocks from Examples 1 and 3 were independently directed to a circulating FCC pilot plant for comparing the benefits and penalties associated with adding solid polystyrene plastic to an FCC. For each feedstock, the pilot plant was operated at a reaction temperature of 950° F., a catalyst to oil ratio (C/O) by weight of 6.0, and a weight hourly space velocity (WHSV) of 15.0. The catalytic cracking catalyst used was Octasiv-plus-580, a USY-sieve catalyst manufactured by Engelhard Corporation, that was removed from the fluid catalytic cracking unit at Amoco Oil Company's Yorktown, Va., Refinery. The cracking catalyst had a catalytic activity (RMA) of 120 and a carbon factor of 1.35. Two runs were made for the LCCO feedstock and three runs for the LCCO/SPS feedstock. The results of the testing are provided in Table 3.

Difficulties were encountered during the LCCO/SPS runs due to the low solubility of the SPS in the LCCO and the resulting high viscosity of the feedstock. The viscosity of the LCCO/SPS blend resulted in the periodic loss of charge pump suction, erratic feedrates, and high reactor pressure differentials, necessitating modification of the feed line and upgrading of the charge pump to accommodate the test. After all of the modifications were incorporated, the pilot plant processed the LCCO/SPS feedstock at reduced capacity.

As expected, the pilot plant results from Table 3 indicate that conversion is substantially increased when solid polystyrene is processed in an FCC because the polystyrene fraction is considered to be hydrocarbon boiling at a temperature in excess of 430° F. at atmospheric pressure and largely decomposes to hydrocarbon boiling at a temperature of below 430° F. at atmospheric pressure.

Of particular concern was the product coke yield for the SPS case, which increased from about 6.4 weight percent for LCCO alone to about 11.3 weight percent for the LCCO/SPS blend. In a commercial heat balanced FCC, this increase in coke yield would elevate regeneration temperatures resulting in lower catalyst to oil ratios and incrementally lower the product value of the entire slate of products processed at the FCC.

TABLE 3

| | LCCO | LCCO | LCCO/SPS | LCCO/SPS | LCCO/SPS |
|---|---|---|---|---|---|
| Run Number | 1 | 2 | 1 | 2 | 3 |
| Product Recovery, Wt % | 97.30 | 97.26 | 96.37 | 95.16 | 96.62 |
| Conversion, Vol % | 47.3 | 46.4 | 55.6 | 56.3 | 58.5 |
| Normalized Product Yield, Wt % | | | | | |
| Hydrogen sulfide | 0.11 | 0.00 | 0.00 | 0.00 | 0.00 |
| Hydrogen | 0.15 | 0.17 | 0.22 | 0.16 | 0.21 |
| Methane | 0.68 | 0.66 | 0.81 | 0.81 | 0.87 |
| Ethylene | 0.57 | 0.57 | 0.61 | 0.62 | 0.66 |
| Ethane | 0.49 | 0.46 | 0.51 | 0.53 | 0.55 |
| Propylene | 2.32 | 2.29 | 2.24 | 2.11 | 2.26 |
| Propene | 1.20 | 1.16 | 1.20 | 1.39 | 1.41 |
| Butylenes | 2.03 | 2.05 | 1.69 | 1.46 | 1.60 |
| Isobutane | 2.76 | 2.70 | 2.32 | 2.57 | 2.62 |
| Normal butane | 0.77 | 0.75 | 0.66 | 0.74 | 0.75 |
| Pentenes | 1.40 | 1.69 | 1.37 | 1.07 | 1.24 |
| Isopentane | 2.74 | 2.86 | 2.25 | 2.38 | 2.46 |
| Normal pentane | 0.25 | 0.26 | 0.21 | 0.20 | 0.23 |
| $C_6$-430° F.$^-$ naphtha | 23.99 | 23.23 | 30.34 | 30.86 | 30.70 |
| 430° F.–650° F.$^-$ LCCO | 46.80 | 48.79 | 38.85 | 36.78 | 36.72 |
| 650° F.$^+$ cycle Oil | 7.29 | 6.04 | 6.12 | 7.27 | 5.50 |
| 430° F$^+$ cycle Oil | 54.09 | 54.83 | 44.97 | 44.05 | 42.21 |
| Coke | 6.44 | 6.32 | 10.61 | 11.06 | 12.23 |
| Weight Recovery, Norm. | 100.00 | 100.00 | 100.00 | 100.00 | 100.00 |

EXAMPLE 6

The LCCO/HS-HVGO and LCCO/HS-HVGO/SPS feedstocks from Examples 2 and 4 were independently directed to a circulating FCC pilot plant for comparing the benefits and penalties associated with adding solid polystyrene plastic to an FCC. For each feedstock, the pilot plant was operated at a reaction temperature of 1000° F., a C/O by weight of 15.0, and a WHSV of 15.0. The catalytic cracking catalyst used for Example 6 was the same Octasiv-plus-580 used for Example 5. One run was made for the LCCO/HS-HVGO feedstock and two runs for the LCCO/HS-HVGO/SPS feedstock. The results of the testing are provided in Table 4.

Again, difficulties were encountered during the testing of the LCCO/HS-HVGO/SPS run due to the low solubility of the SPS in the LCCO/HS-HVGO and the resulting high viscosity of the feedstock. The addition of HS-HVGO also caused the SPS to precipitate out of solution. In order to maintain the solubility of the SPS in the LCCO/HS-HVGO, the charge pot was heated to a temperature in excess of 260° F. and heat lamps were positioned over the charge pump in an effort to eliminate cold spots along the feed system. After all of these precautions were implemented, the feed line plugged up upon initial injection of feed to the process. Once the feed line was unplugged and the system fully heated, flow was maintained at near capacity.

The pilot plant results from Table 4 again indicated that conversion is increased when solid polystyrene is processed for the reasons described above with respect to Example 5. The absolute level of conversion was greater than that for the LCCO/SPS feedstock tested in Example 5 because the HS-HVGO is more reactive and more readily converts to 430° F.-hydrocarbon than an equivalent amount of LCCO. The increase in conversion between the LCCO/HS-HVGO/SPS feedstock and the LCCO/HS-HVGO feedstock is less than that for the LCCO feedstock only because the SPS concentration increases to only 14 weight percent SPS instead of 25 weight percent SPS for the LCCO feedstock only case.

The coke yield again increased from about 7.6 weight percent for LCCO/HS-HVGO alone to about 8.8 weight percent for the LCCO/HS-HVGO/SPS blend. The increase in coke yield for the LCCO/HS-HVGO/SPS blend compared to the LCCO/HS-HVGO blend was not as great as that for the LCCO/SPS blend over the LCCO feedstock only because the HS-HVGO feedstock component is generally more hydrogen-rich than LCCO.

Examples 5 and 6 clearly illustrate that the addition of solid polystyrene plastic to an FCC undesirably increases FCC coke yield. This increase in coke yield would elevate regenerator temperature in a commercial FCC, result in a lower catalyst to oil ratio, and thereby reduce the product value of the entire product slate produced at the FCC.

TABLE 4

| | LCCO/ HS-HVGO | LCCO/ HS-HVGO /SPS | LCCO/ HS-HVGO /SPS |
|---|---|---|---|
| Run Number | 1 | 1 | 2 |
| Product Recovery, Wt % | 97.44 | 95.02 | 95.66 |
| Conversion, Vol % | 62.5 | 65.9 | 65.9 |
| Normalized Product Yield, Wt % | | | |
| Hydrogen sulfide | 0.84 | 0.64 | 0.61 |
| Hydrogen | 0.25 | 0.25 | 0.25 |
| Methane | 1.18 | 1.25 | 1.23 |
| Ethylene | 0.78 | 0.80 | 0.81 |
| Ethane | 0.83 | 0.83 | 0.81 |
| Propylene | 4.10 | 3.98 | 4.01 |
| Propane | 1.53 | 1.54 | 1.51 |
| Butylenes | 4.52 | 3.96 | 4.13 |
| Isobutane | 3.42 | 3.03 | 3.04 |
| Normal butane | 0.99 | 0.89 | 0.89 |
| Pentenes | 3.09 | 2.57 | 2.83 |
| Isopentane | 3.43 | 2.70 | 2.78 |
| Normal pentane | 0.48 | 0.38 | 0.39 |
| $C_6$-430° F.$^-$ naphtha | 26.95 | 32.14 | 31.77 |
| 430° F.–650° F. LCCO | 32.93 | 28.02 | 22.04 |
| 650° F.$^+$ cycle Oil | 7.09 | 8.20 | 14.16 |
| 430° F.$^+$ cycle Oil | 40.02 | 36.22 | 36.20 |
| Coke | 7.61 | 8.83 | 8.75 |
| Weight Recovery, Norm. | 100.00 | 100.00 | 100.0 |

EXAMPLE 7

Several liquid styrene oligomer-containing feedstock (LSO) samples, in accordance with the present invention and from Amoco Chemical Company's Joliet Polystyrene Commercial Manufacturing Facility, were collected for developing solubility criteria, investigating the potential for equipment pluggage (Examples 7–10), and for further yields testing as described in Examples 11–12. A composite composition of the LSO streams is set forth in Table 5. An elemental analysis of the composite LSO stream is set forth in Table 6.

TABLE 5

| LSO | Vol % |
|---|---|
| Styrene | 23.0 |
| Ethylbenzene | 2.0 |
| Other $C_8$–$C_{10}$ Hydrocarbon | 4.0 |
| Dimers | 14.0 |
| Trimers | 17.0 |
| Oligomers | 13.0 |
| USP - 21 Mineral Oil | 26.0 |
| Other High Boiling Hydrocarbon | 1.0 |
| | 100.0 |

TABLE 6

| Composition, Wt % (ppm) | LSO | LSO - Upper Phase | LSO - Lower Phase |
|---|---|---|---|
| C | 88.50 | 89.32 | 88.23 |
| H | 11.49 | 8.76 | 11.50 |
| N | <0.30 | <0.30 | <0.30 |
| O | 0.51 | ND | ND |
| S | (276) | ND | ND |
| Cl | (9) | (8) | (13) |
| $C_a$ | ND | 42.1 | 69.3 |
| Na | (4.0) | (3.9) | (1.8) |
| Mg | (0.08) | (0.1) | (0.08) |
| K | (4) | (3) | ND |
| Ca | (0.7) | (0.6) | (0.5) |
| V | (0.2) | (0.2) | (.1) |
| Cr | (1.4) | (1.6) | (1.5) |
| Mn | (0.32) | (0.19) | (0.48) |
| Fe | (105) | (73) | (45) |
| Co | ND | ND | ND |
| Ni | ND | ND | ND |
| Cu | (3.2) | (0.5) | (19.5) |
| Zn | (0.6) | (0.4) | (0.4) |
| Mo | ND | ND | ND |
| Pb | ND | ND | ND |

ND - Not Determined

A sample of LSO was added to a glass bottle and observed at ambient conditions. Initially the solution was relatively homogeneous and formed a single phase. After standing for a period of 24 hours, the solution separated into two distinct phases consisting of from about 80 to about 90 volume percent of an upper light phase and from about 10 to about 20 volume percent of a lower heavy phase. An elemental analysis of the upper and lower phases of the LSO stream is set forth in Table 6.

The LSO sample was heated from ambient conditions to a temperature of about 212° F. The two liquid phase solution returned to a single, relatively homogeneous phase.

EXAMPLE 8

The LSO of Example 7 was combined with an equal volume of a normal paraffinic solvent comprising n-dodecane and observed at ambient conditions. A gummy precipitate immediately formed upon addition of the normal paraffinic solvent.

The LSO/n-paraffinic solvent mixture was heated from ambient conditions to a temperature of about 212° F. The gummy precipitate rapidly melted, leaving two distinct liquid phases.

EXAMPLE 9

The LSO/n-paraffinic solvent mixture of Example 8 was combined with LCCO in a manner so as to form a solution having equal volumes of LSO and n-paraffinic solvent and 25 volume percent of LCCO, and observed at ambient conditions. A reduced amount of gummy precipitate formed at the bottom of the glass bottle. The solution formed two distinct phases consisting of an upper hazy liquid phase and a lower and darker heavy phase.

The LSO/n-paraffinic solvent/LCCO mixture was heated from ambient conditions to a temperature of about 212° F. The two phases formed one hazy liquid phase.

EXAMPLE 10

A sample of the gummy precipitate from Example 8, formed at ambient conditions, was removed from the glass bottle and added to an equal volume of LCCO. The gummy precipitate dissolved in the LCCO and formed a clear solution. The solution of gummy precipitate and LCCO was cooled from ambient conditions to 32° F. The solution remained clear.

The results of Examples 7–10 indicate that the LSO feedstock in accordance with the present invention can be conveyed and processed to an FCC at operatively low temperatures and need not be substantially heated or dissolved prior to processing. The LSO can be conveyed to the FCC at temperatures as low as or lower than 212° F. with minimum risk of equipment pluggage. For improved results, the LSO may be stored in separate storage facilities in order to reduce contact with paraffinic feedstocks that may result in the formation of precipitates. Aromatic hydrocarbons such as LCCO and toluene can be employed as solvents for dissolving any precipitates that may form during processing. Such solvents are generally effective for dissolving LSO precipitates to operating temperatures below ambient and as low as or lower than 32° F.

EXAMPLE 11

A fluid catalytic cracking unit feedstock from the Amoco Oil Company Texas City refinery was directed to a microactivity test unit (MYU) similar to that described in ASTM Test Method D 3907-87. The feedstock was reacted with Octasiv-plus-580 catalytic cracking catalyst manufactured by Engelhard Corporation at a reaction temperature of 970° F. for a period of about 50 seconds. Conversion was adjusted to a level of about 65% by varying the catalyst to oil ratio. The MYU product inspections for the 100% catalytic cracking unit feedstock case am provided in Table 7.

LSO from Example 7 was blended into the fluid catalytic cracking unit feedstock from this Example 11 in a manner so as to form three feedstocks having 1.0 percent, 5.0 percent, and 15.0 percent by weight LSO in the composite feedstock of LSO and fluid catalytic cracking unit feedstock. The LSO-containing feedstocks were processed into the MYU at conditions substantially similar to those described above. The MYU product inspections for the 1.0, 5.0, and 15.0 weight percent LSO cases are also provided in Table 7.

TABLE 7

| LSO, Wt % In Feed | 0.0 | 1.0 | 5.0 | 15.0 |
|---|---|---|---|---|
| Product Yield, Wt % | | | | |
| $TC_2$ | 2.5 | 2.4 | 2.3 | 1.9 |

TABLE 7-continued

| | | | | |
|---|---|---|---|---|
| $TC_3$ | 5.2 | 5.1 | 4.7 | 4.4 |
| $TC_4$ | 8.8 | 9.0 | 7.1 | 7.7 |
| $TC_5$ | 4.0 | 4.5 | 3.8 | 3.6 |
| $C_5$-430° F.$^-$ | 43.9 | 43.6 | 45.9 | 46.2 |
| Coke | 4.0 | 3.9 | 3.7 | 3.5 |
| Octane, $C_5$-430° F.$^-$ | | | | |
| RON (GC) | 93.8 | 93.9 | 94.3 | 95.0 |
| MON (GC) | 80.9 | 81.2 | 81.5 | 82.7 |
| Olefins, Wt Ratio/Wt % | | | | |
| $C_3 = /C_3$ | 0.82 | 0.82 | 0.82 | 0.81 |
| $C_4 = /C_4$ | 0.62 | 0.62 | 0.53 | 0.57 |
| $C_5 = /C_5$ | 0.21 | 0.29 | 0.18 | 0.18 |
| $IC_4 =$ | 1.61 | 1.65 | 1.51 | 1.47 |
| $IC_5 =$ | 0.77 | 1.08 | 0.42 | 0.74 |
| Aromatics, $C_5$-430° F.$^-$, Wt % | | | | |
| $A_6$ | 0.7 | 0.7 | 0.8 | 1.0 |
| $A_7$ | 2.8 | 2.8 | 3.0 | 2.8 |
| $A_8$ | 7.3 | 8.0 | 10.5 | 15.5 |
| $A_9$ | 9.4 | 9.2 | 9.5 | 8.4 |
| $A_{10}$ | 8.3 | 8.3 | 8.6 | 7.6 |
| Total | 28.5 | 29.0 | 32.4 | 35.3 |

The MYU tests clearly illustrate that as the weight percentage of LSO in the fluid catalytic cracking feedstock is increased, the $C_5$-430° F.-yield is increased because the LSO was considered to be hydrocarbon boiling at a temperature in excess of 430° F. at atmospheric pressure and was largely converted to hydrocarbon boiling at a temperature of below 430° F. at atmospheric pressure. The research and motor octane of the $C_5$-430° F.-hydrocarbon was also increased because the LSO was largely converted to high octane aromatics, such as ethylbenzene, as evidenced by the increase in yield of aromatic hydrocarbon having 8 carbon atoms.

Of particular importance is the surprising and unexpected reduction in coke yield experienced as the concentration of LSO in the fluid catalytic cracking feedstock was increased. As the concentration of LSO in the feedstock increased from 0.0 weight percent to 15.0 weight percent, coke yield decreased from 4.0 weight percent to 3.5 weight percent or by about 12.5 percent. This coke yield reduction was experienced as a result of the increase in the concentration of LSO in the feedstock, notwithstanding the fact that extensive data has been generated showing that the addition of solid polymeric wastes, such as the SPS tested in Examples 5 and 6, substantially increased coke yield.

In a commercial FCC, this coke reduction would result in lower regeneration temperatures thereby permitting higher catalyst to oil ratios and a further improvement in conversion, gasoline yield, and gasoline octane. It is also expected that this reduction in coke yield could reduce energy costs in terms of FCC air compression requirements, and, where air compression is an FCC capacity bottleneck, increase FCC capacity. This data clearly illustrates that addition of LSO to an FCC results in an upgrade of the LSO from a waste product having a negative value, to marketable fuel products such as high octane gasoline. The addition of LSO to an FCC also favorably effects FCC performance in such a manner as to enhance product yields and contribute other advantages that beneficially affect the entire feed slate processed at an FCC.

EXAMPLE 12

An HS-HVGO feedstock similar to that described in Example 2 was directed to a circulating FCC pilot plant for comparing the benefits and penalties associated with adding LSO to an FCC. The pilot plant was operated at a reaction temperature of 950° F., a C/O by weight of 9.2, a WHSV of 43.0, an inlet feed partial pressure of 10 psia, and at a feedrate of 14.5 g/min. The catalytic cracking catalyst used was Octacat AD, a USY-sieve catalyst manufactured by Engelhard Corporation. The results of the testing are provided in Table 8.

LSO from Example 7 was blended into the HS-HVGO feedstock in a manner so as to form a feedstock having 5.0 percent by weight LSO in the composite feedstock of LSO and HS-HVGO. The LSO-containing feedstock was processed into the pilot plant at conditions substantially similar to those described above. The results of the testing are provided in Table 8.

TABLE 8

| | | |
|---|---|---|
| LSO Wt % In Feed | 0.0 | 5.0 |
| Product Recovery, Wt % | 99.88 | 99.25 |
| Conversion, Vol % | 69.19 | 70.57 |
| Product Yields, Wt % | | |
| Hydrogen Sulfide | 0.81 | 0.70 |
| Hydrogen | 0.10 | 0.11 |
| Methane | 0.80 | 0.79 |
| Ethylene | 0.57 | 0.56 |
| Ethane | 0.61 | 0.59 |
| Propylene | 3.84 | 3.83 |
| Propane | 0.80 | 0.80 |
| Isobutane | 2.39 | 2.30 |
| Normal butane | 0.54 | 0.51 |
| Isobutylene + 1 Butylene | 3.12 | 3.13 |
| Transbutylene | 1.64 | 1.62 |
| Cis Butylene | 1.17 | 1.16 |
| Isopentane + Cyclopentane | 2.58 | 2.41 |
| Normal Pentane | 0.45 | 0.43 |
| Amylene | 5.43 | 5.33 |
| Coke | 4.85 | 4.75 |
| $C_5$-430° F.$^-$, Vol % | 56.77 | 58.61 |
| Qualities | | |
| C5-430° F.$^-$ | | |
| RON, Adjusted | 91.5 | 92.3 |
| MON, Adjusted | 81.2 | 81.3 |
| Br Number, g/100 g | 72.4 | 69.6 |
| Gum BW, mg/100 cc | 39.9 | 38.7 |
| Gum AW, mg/100 cc | 31.6 | 24.2 |
| Induction Period, Min. | 108.3 | 159.5 |
| 430° F.–650° F. | | |
| Br Number, g/100 g | 16.2 | 14.0 |
| Induction Period, Min. | >960 | >960 |

The results in Table 8 illustrate that at constant C/O, conversion is about 1.5 percent higher for the feedstock containing LSO. This again occurs in part because the LSO was considered to be hydrocarbon boiling at a temperature in excess of 430° F. at atmospheric pressure and was largely converted to hydrocarbon boiling at a temperature of below 430° F. at atmospheric pressure. The gasoline yield and research octane were also increased by about 1.8 volume percent and 0.8 RON respectively because the LSO was largely converted to high octane gasoline boiling range aromatics such as ethylbenzene.

The coke yield was again lower for the LSO-containing feedstock than for the HS-HVGO feedstock alone. Extrapolating the yield results for the LSO-containing feedstock to the same increased coke level as for the HS-HVGO feedstock alone would result in a further increase in FCC conversion, gasoline yield, and gasoline octane. Extrapolating the data to a constant coke yield is generally appropriate when assessing the comparative commercial benefits of an FCC process because commercial FCCs generally operate at constant reaction temperatures, because constant coke yield generally correlates to a constant regenerator temperature, and because constant regenerator and reaction temperatures correlate to a relatively constant and comparative C/O. The enhanced benefits from increasing coke yield compared to the data in Table 8 would occur because at constant feedrate and feed composition, the increased coke level would be obtained by increasing the C/O, which would result in increased conversion, gasoline yield, and gasoline octane. Therefore, the benefits in conversion, gasoline yield, and increased octane are projected to be even greater than set forth in Table 8, when adjusted to a constant coke yield basis as appropriate for comparing commercial FCC operations.

Other embodiments of the invention will be apparent to those skilled in the art from a consideration of this specification or from practice of the invention disclosed herein. It is intended that this specification be considered as exemplary only with the true scope and spirit of the invention being indicated by the following claims.

That which is claimed is:

1. A process for converting a hydrocarbon feedstock comprising at least 2 volume percent of a low molecular weight oligomer having a molecular weight ranging from about 58 to about 55,000 to hydrocarbon product useful in the manufacture of fuels comprising contacting said hydrocarbon feedstock with a catalytic cracking catalyst at catalytic cracking conditions for convening at least a portion of said low molecular weight oligomer to hydrocarbon suitable for blending into fuels.

2. The process of claim 1 wherein said feedstock further comprises unpolymerized monomers, dimers, and trimers and the composite of said unpolymerized monomers, dimers, and trimers is at least 10 volume percent of said hydrocarbon feedstock.

3. The process of claim 1 wherein said low molecular weight oligomer comprises at least one monomer selected from the group consisting of ethylene, propylene, butylene, methylstyrene, and styrene.

4. The process of claim 2 wherein said hydrocarbon feedstock comprises at least 5 volume percent of low molecular weight oligomer and said low molecular weight oligomer comprises styrene monomer.

5. The process of claim 1 wherein said catalytic cracking conditions comprise a reaction temperature of from about 900° F. to about 1100° F. and a reaction pressure of from about 0 psig to about 100 psig.

6. The process of claim 1 wherein said catalytic cracking process comprises a catalytic cracking feedstock injection system downstream of a catalytic cracking feedstock preheat system and said hydrocarbon feedstock is injected into said catalytic cracking process downstream of said feedstock preheat system and upstream of or as part of said feedstock injection system.

7. The process of claim 1 wherein said catalytic cracking process processes and converts catalytic cracking feedstock to upgraded products and said hydrocarbon feedstock is injected into said catalytic cracking process at a volume percentage, calculated as a percentage of the sum of said catalytic cracking feedstock and said hydrocarbon feedstock processed in said catalytic cracking process, of from about 0.10 to about 25.0.

8. A process for converting a liquid hydrocarbon feedstock comprising at least 5 volume percent of a low molecular weight oligomer having a molecular weight ranging from about 100 to about 30,000 and at least 10 volume percent of a composite stream of unpolymerized monomers, dimers, and trimers, to hydrocarbon product useful in the manufacture of fuels comprising contacting said hydrocarbon feedstock with a catalytic cracking catalyst at catalytic cracking conditions in a catalytic cracking process for converting at least a portion of said low molecular weight oligomer to hydrocarbon having a lower molecular weight.

9. The process of claim 8 wherein said hydrocarbon feedstock comprises at least 5 volume percent of low molecular weight oligomer and said low molecular weight oligomer comprises at least one monomer selected from the group consisting of ethylene, propylene, butylene, methylstyrene and styrene.

10. The process of claim 8 wherein said hydrocarbon feedstock comprises at least 25 volume percent of the total of said composite stream of unpolymerized monomers, dimers, and trimers, and said low molecular weight oligomer.

11. The process of claim 8 wherein said hydrocarbon feedstock has a viscosity at 212° F. of not more than 1000 cs and a molecular weight ranging from about 200 to about 15,000.

12. The process of claim 8 wherein said catalytic cracking conditions comprise a reaction temperature of from about 900° F. to about 1100° F. and a reaction pressure of from about 0 psig to about 100 psig.

13. The process of claim 8 wherein said catalytic cracking process comprises a catalytic cracking feedstock preheat system, injection system, reaction system, catalyst disengaging system, catalyst stripping system, catalyst regeneration system, regenerated catalyst supply system, and product fractionation system and said hydrocarbon feedstock is injected into at least one system selected from the group consisting of said injection system, said reaction system, said catalyst disengaging system, said catalyst stripping system, and said regenerated catalyst supply system.

14. The process of claim 8 wherein said catalytic cracking process processes and converts catalytic cracking feedstock to upgraded products and said hydrocarbon feedstock is injected into said catalytic cracking process at a volume percentage, calculated as a percentage of the sum of said catalytic cracking feedstock and said hydrocarbon feedstock processed in said catalytic cracking process, of from about 0.10 to about 15.0.

15. A process for converting a liquid hydrocarbon feedstock comprising at least 5 volume percent of a low molecular weight oligomer having a molecular weight of between about 100 and about 30,000 and at least 20 volume percent of the total of all unpolymerized monomers, dimers, and trimers, to hydrocarbon product useful in the manufacture of fuels comprising contacting said hydrocarbon feedstock with a catalytic cracking catalyst at catalytic cracking conditions comprising a reaction temperature ranging from about 900° F. to about 1100° F. and a reaction pressure ranging from about 0 psig to about 100 psig, in a catalytic cracking process for converting at least a portion of said low molecular weight oligomer to hydrocarbon having a lower molecular weight.

16. The process of claim 15 wherein said hydrocarbon feedstock comprises at least 10 volume percent of low molecular weight oligomer and said low molecular weight oligomer comprises styrene.

17. The process of claim 15 wherein said hydrocarbon feedstock comprises at least 10 volume percent of low molecular weight oligomer and said hydrocarbon feedstock comprises at least 50 volume percent of said composite stream of unpolymerized monomers, dimers, and trimers, and said low molecular oligomer.

18. The process of claim 17 wherein said hydrocarbon feedstock has a viscosity at 212° F. of not more than 1000 cs and a molecular weight ranging from about 200 to about 15,000.

19. The process of claim 18 wherein said catalytic cracking process processes and converts catalytic cracking feedstock to upgraded products and said hydrocarbon feedstock is injected into said catalytic cracking process at a volume percentage, calculated as a percentage of the sum of said catalytic cracking feedstock and said hydrocarbon feedstock processed in said catalytic cracking process, of from about 0.10 to about 15.0.

20. The process of claim 19 wherein said catalytic cracking process comprises a catalytic cracking feedstock preheat system, injection system, reaction system, catalyst disengaging system, catalyst stripping system, catalyst regeneration system, regenerated catalyst supply system, and product fractionation system and said hydrocarbon feedstock is injected into at least one system selected from the group consisting of said injection system, said reaction system, and said catalyst disengaging system.

* * * * *

UNITED STATES PATENT AND TRADEMARK OFFICE
CERTIFICATE OF CORRECTION

PATENT NO.: 5,443,716

DATED: August 22, 1995

INVENTOR(S): Ken B. Anderson, Jeffrey T. Miller

It is certified that error appears in the above-identified patent and that said Letters Patent is hereby corrected as shown below:

Patent reads:

| Col. | Line | |
|---|---|---|
| 4 | 53-54 | "20 volume percent of the composite of monomers, dimers, and trimers" should read --20 volume percent of the composite of unpolymerized monomers, dimers, and trimers-- |
| 17 | 9 | in "TABLE 3" in the column titled "Normalized Product Yield, Wt %" patent reads "Propene" patent should read --Propane-- |
| Claims: | | |
| 23 | 26-27 | "catalytic cracking conditions for convening at least a portion of said low molecular weight oligomer" should read --catalytic cracking conditions for converting at least a portion of said low molecular weight oligomer-- |

Signed and Sealed this

Twenty-seventh Day of February, 1996

*Attest:*

Bruce Lehman

BRUCE LEHMAN

*Attesting Officer*

*Commissioner of Patents and Trademarks*